US005609102A

United States Patent [19]

Rapp

[11] Patent Number: 5,609,102

[45] Date of Patent: Mar. 11, 1997

[54] FIXTURE FOR HOLDING A COMPACT DISC TO BE SILK-SCREEN PRINTED

[75] Inventor: Chris P. Rapp, Nashua, N.H.

[73] Assignee: Autoroll Machine Corporation, Middleton, Mass.

[21] Appl. No.: 373,548

[22] Filed: Jan. 17, 1995

[51] Int. Cl.[6] ..... B41F 15/36

[52] U.S. Cl. ..... 101/127.1; 101/35

[58] Field of Search ..... 101/114, 115, 101/126, 127, 127.1, 123, 124, 129, 4, 35; 206/308.1, 308.3, 310

[56] References Cited

U.S. PATENT DOCUMENTS

| | | | |
|---|---|---|---|
| 3,949,872 | 4/1976 | Paudras | 206/310 |
| 4,535,888 | 8/1985 | Nusselder | 206/308.1 |
| 5,123,005 | 6/1992 | Kurosu | 369/77.1 |
| 5,249,677 | 10/1993 | Lim | 206/308.1 |
| 5,402,718 | 4/1995 | Rigodiat | 101/126 |
| 5,429,045 | 7/1995 | Karlyn et al. | 101/35 |

*Primary Examiner*—Edgar S. Burr
*Assistant Examiner*—Anthony H. Nguyen
*Attorney, Agent, or Firm*—Herbert L. Gatewood

[57] ABSTRACT

A fixture is provided for the holding of a compact disc on a transport member for transportation of the disc to one or more work stations such as a silk-screen printing station. The fixture has a top member in which is provided a circular-shaped opening detachably connected to a base member. The base member is secured to the transport member. When the base member and top member are in combination with one another, the circular-shaped opening provides a well for the compact disc. Magnets are located in the base member to detachably hold the top member in contact with the base member.

23 Claims, 1 Drawing Sheet

FIXTURE FOR HOLDING A COMPACT DISC TO BE SILK-SCREEN PRINTED

BACKGROUND OF THE INVENTION (1). Field of the Invention

This invention relates, in general, to a fixture provided on a rotatable transport member for holding a compact disc while such is being transported from a loading point, to one or more printing locations, and hence to an unloading point. More particularly, the invention relates to a compact disc fixture that can be readily modified for holding compact discs of different diameters and thicknesses.

(2). Description of the Prior Art

In U.S. Pat. No. 5,165,340, which issued on Nov. 24, 1992, and which is entitled Multicolor Printing System For The Silk-Screen Printing Of Compact Discs, there is disclosed a fixture or tooling member for the holding of a compact disc. The fixture is, in general, of one piece and is defined by top and bottom planar surfaces, the bottom surface being supported by the top planar, horizontally disposed, surface of an annular-shaped rotatable transport member. The compact disc fixture is secured to the transport member by conventional threaded fasteners.

The fixture is provided with a circular-shaped well or nest which extends inwardly from the top surface of the fixture for the holding of a compact disc. The depth of the well is such that the top surface of the compact disc, when loaded into the well, is to be in the same plane as, or not more than about 0.003 inch above, the top surface of the fixture. This is of critical importance so that when the top surface of the compact disc is being silk-screen printed the squeegee will engage one continuous surface.

The compact disc fixture in U.S. Pat. No. 5,165,340 is provided also with a bottom, horizontally disposed, circular-shaped well in opposition to the top well, the two wells being separated by a horizontally disposed bridge in which a plurality of openings are provided. This allows communication between the two wells. The bottom well serves as a plenum by means of which vacuum is supplied to the upper or top well through the openings provided in the bridge. This vacuum serves to maintain a compact disc located in the top well, after being registered by an elongated pin raised vertically upwardly so as to intrude into the centerhole of the compact disc, in precise registration for the subsequent silk-screen printing of the top surface of the disc.

Although the compact disc fixture disclosed in U.S. Pat. No. 5,165,340 has functioned quite well in the past for its intended purpose, its use now is, nevertheless, attendant with certain problems and disadvantages. One such disadvantage is that such a disc fixture will accommodate compact discs of only one size, i.e., of only one diameter and thickness. This restriction has presented no particular problem, in the past, in the case of the diameter, as compact discs have been of only one diameter. More recently, however, compact discs have been made available of not only 120 mm diameter, but also of a number of other smaller or larger diameters, and of various thicknesses.

Thus, to allow for the silk-screen printing of any of these compact discs or any other sizes of discs to emerge in the market place, those in the business of printing compact discs must maintain an inventory of disc fixtures of various diameters so that whichever diameter compact discs are to be printed, the transport member can be provided with fixtures having a top well or nest of the needed diameter. This, however, is a costly proposition. The rotatable transport member in a compact disc printing apparatus may have, in general, as many as thirty or more fixtures mounted on it. Moreover, not only is it expensive to maintain a complete inventory of fixtures of different diameters, the replacement of a disc fixture having a compact disc nest of one diameter on the transport member with one of a different diameter is a labor intensive operation. This naturally leads to increased and undesirable overhead costs. The replacement of a compact disc fixture on a transport member with one of a different diameter requires, in general, that the fixture being replaced be disconnected from the transport member, e.g., by removal of the threaded fasteners. The replacement fixtures must then each be fastened to the transport members by the same threaded fasteners removed.

Another disadvantage with the use of compact disc fixtures such as disclosed in U.S. Pat. No. 5,165,340 results from the fact that, on occasion, the top surface of the fixture becomes damaged, e.g., by gouges or burrs in the top surface. When this occurs, the compact disc fixture must be replaced with another fixture; otherwise, the surface of the compact disc will not be uniformly printed or the silk screen may be damaged. The fixture that is replaced is no longer of any value and is discarded. Overtime, a large number, if not all, of the compact disc fixtures initially provided on the rotatable transport member of a silk-screen printing apparatus may need be replaced. This, of course, leads to increased costs of operation to the silk-screen printer operator.

Compact discs of somewhat different thicknesses, on the other hand, have always presented a problem in the silk-screen printing, offset printing, or other methods of printing of the top surface of the disc. This results from the fact that compact discs received by a printer from different molding machines or molds may be of slightly different thicknesses. As a matter of fact, even with a single source of compact discs, where the compact discs are molded on different apparatus, the thicknesses of the compact discs from the different apparatus may be somewhat different. Also, new disc technologies for video discs and writable and multi-layer discs dictate thicknesses which are different than that of conventional audio compact discs.

It is, of course, critical that the thickness of a compact disc correspond with the depth of the top well of the disc fixture being used in the printing operation. This is critically necessary, as above-mentioned, so that the squeegee on a silk-screen printing head, or print head on an offset print head, or other process head will meet a continuous planar surface in its travel. Where a batch of compact discs are encountered by a printer operator having a thickness different, i.e., greater or less, from that of the depth of the top well of the fixtures on the printing apparatus to be used, the compact disc fixtures may need be replaced. Otherwise, the compact disc surface may not be suitably printed. This, of course, means the replacement of thirty or so disc fixtures with fixtures having a top well of the required depth.

Thus, it can readily be seen that there is need for a compact disc fixture that is capable of readily accommodating compact discs of different diameters and thicknesses, and in an economical manner.

SUMMARY OF THE INVENTION

The present invention has as a primary object the realization of a fixture or tool for the holding of a compact disc in registration while such is being transported to and from a work station not having the problems and disadvantages of compact disc fixtures now known and used such as above-disclosed.

Another object of the present invention is to provide a compact disc fixture of relatively simple design and construction.

A further object of the invention is to provide a compact disc fixture having a top member in which is provided a well for the holding of a compact disc and which is detachably connected to a base member which is connected to the transport member.

A still further object of the invention is to provide detachable top members for use in a compact disc fixture which top members can be provided of different thicknesses and with compact disc wells of different diameters whereby compact discs of different diameters and thicknesses can be readily accommodated for the silk-screen printing of the top surface of the compact disc.

A still further object of the invention is to provide a disc fixture with a detachable top member whereby, in case the top surface of the top member of the fixture is nicked or damaged, the fixture can be provided with a new top surface by merely replacing the top member with another rather than having to replace the entire fixture.

An important advantage of the invention is that a silk-screen printer operator need not keep on hand an inventory of costly compact disc fixtures having wells of different diameters and thicknesses.

The present invention, quite advantageously, makes it possible for a compact disc printer to obtain silk-screen printing apparatus with compact disc fixtures that can be readily retrofitted for the printing of compact discs of any diameter and thickness.

BRIEF DESCRIPTION OF THE DRAWINGS

For a better understanding of the invention disclosed herein, reference should be made to the following detailed description of the preferred embodiments of the invention, taken in conjunction with a review of the accompanying drawings, in which.

DETAILED DESCRIPTION OF THE PREFERRED EMBODIMENTS OF THE INVENTION

Although the present invention will be described hereinafter with particular reference to the accompanying drawings, it is to be understood at the outset that it is contemplated that the invention may be varied in specific detail from that illustrated and described while still achieving the desirable characteristics of the present invention. Accordingly, the description that follows is intended to be a broad enabling disclosure directed to a person skilled in the applicable arts, and is not intended to be restrictive.

Figure 1:
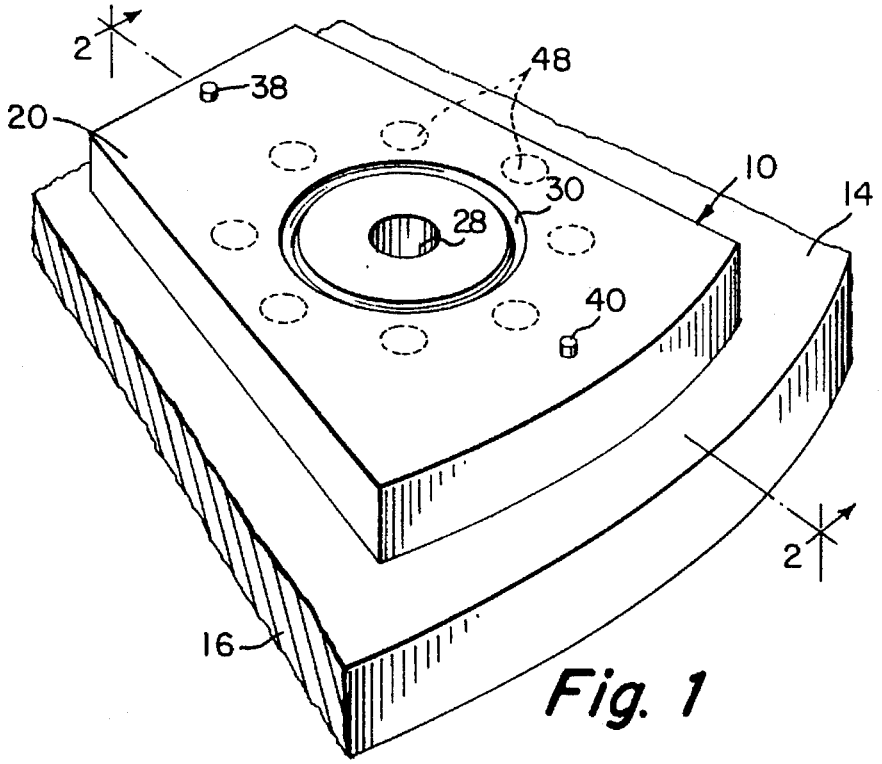
FIG. 1 is a view in perspective showing the base member of a compact disc fixture according to the invention mounted on the top planar surface of a rotatable transport member without a top member being located on the base member.
Figure 2:
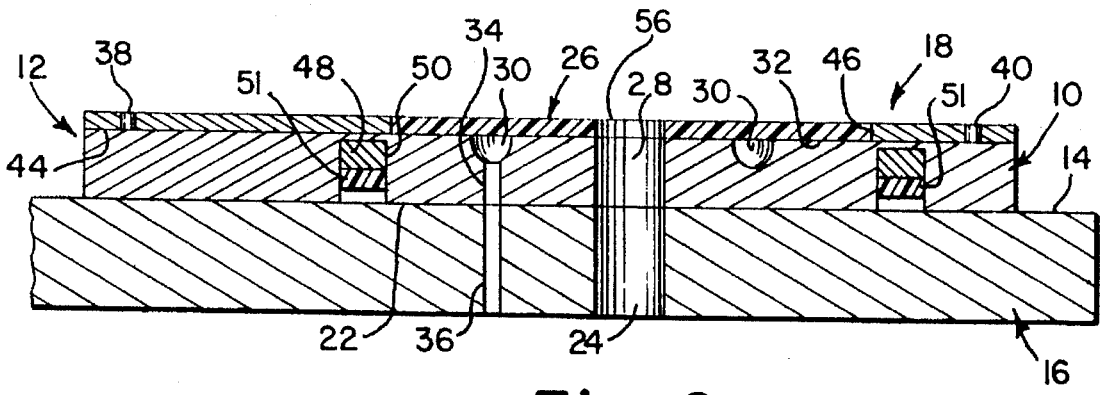
FIG. 2 is a cross-sectional view of the base member of the compact disc fixture and transport member shown in FIG. 1 taken at secant lines 2—2 and showing the top member being mounted to the base member and a compact disc being located in the well of the top member of the fixture.

Turning now to the drawings, there is shown in FIG. 1 the base member 10 of a compact disc fixture or tool 12 (FIG. 2) mounted on the top surface 14 of a rotatable transport member 16. The base member 10 can be connected to the transport member by various conventional means, for example, threaded fasteners. The compact disc fixture 12, as shown in FIG. 2, comprises, in addition to the base member, a top member or mask 18.

The base member 10 is defined by top and bottom planar surfaces 20, 22, these being parallel to one another, the bottom surface 22 being supported by the horizontally disposed, top planar surface 14 of the rotatable transport member. In the transport member 16, there is provided an elongated, vertically disposed, circular-shaped opening 24, the purpose for which will be readily appreciated by reference to U.S. Pat. No. 5,165,340, the entire disclosure of which is incorporated herein by reference. In general, an elongated registration pin located below the transport member is raised vertically upwardly through the elongated opening 24 for registration of a compact disc 26 loaded into the compact disc fixture, as later more fully disclosed. The base member 10 is provided with an elongated circular-shaped opening 28 of the same diameter as opening 24 and in direct alignment with that opening, as best seen in FIG. 2 of the drawing.

Referring now to FIG. 1 of the drawing, it will be seen that the base member 10 is provided with an annular-shaped groove 30 of somewhat larger diameter than the circular-shaped opening 28 and in concentric relationship with that last-mentioned opening. The groove 30 has the cross-section of a half-circle and extends inwardly into the top surface 20 of the base member 10. The diameter of the groove 30 is of no particular consequence and neither is the cross-sectional diameter of the groove. The cross-section of the groove need, however, be sufficient to serve as a manifold for the vacuum provided to the bottom side 32 of the compact disc 26. Although the cross-sectional shape of the groove 30 is seen to be circular; it can be of a different cross-section, if desired.

Extending downwardly from groove 30 there is provided in the base member 10 an elongated passageway 34 which is in communication with the elongated passageway 36 provided in the transport member 16. These passageways can be of any cross-section desired; however, in general, the passageways will be of circular-shaped cross-section as such can be readily provided. Whatever the shape of passageways 34, 36, however, the two passageways will be, desirably, of the same shape and lateral dimension so as to present a continuous passageway from the groove 30. Although not shown in the drawing, as such forms no part of the present invention, the bottom open end of the passageway 36 is connected to a source of vacuum. This vacuum being distributed around the groove 30 holds the compact disc firmly in place.

Provided on the top surface 20 of the base member 10 and extending vertically upwardly and perpendicular to that surface are elongated pins 38, 40, the purpose for which will soon be made clear, if not already known. The length of these pins is critical, as will be later more fully appreciated. The orientation or position of the pins 38, 40 is on no real concern provided such mate with means in the top member for proper registration of the top member 18 on the base member 10, to be later made more clear. The pins 38, 40 each lie on an extension of the diameter of the circular-shaped opening 28 in the base member 10, and in opposition to one another.

Figure 3:
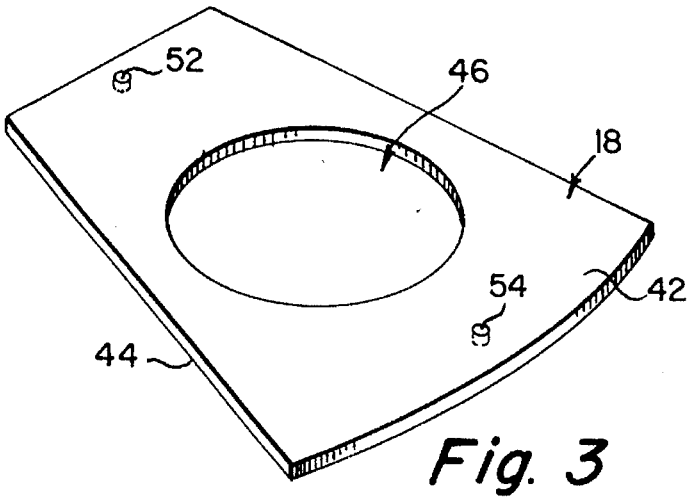
FIG. 3 is a view in perspective of a top member of a compact disc fixture according to the invention showing the circular-shaped well for location of a compact disc and opposed circular-shaped openings for the registration of the top member with the base member of the fixture.

The top member 18, as will be appreciated from reference to FIG. 3 of the drawing, is defined by top and bottom planar surfaces 42, 44, in parallel disposition to one another. The top member 18 is further defined by a circular-shaped opening 46 which provides, when the top member is in contact with the base member 10, later more fully disclosed, a nest or well for holding the compact disc 26, as best seen in FIG. 2 of the drawing.

The diameter of the opening 46, although pretermined, will depend upon the diameter of the compact discs to be silk-screen printed. It will be appreciated that, whatever the diameter of the circular-shaped opening 46, it will be greater than that of the annular-shaped groove 30. The thickness of the top member can be varied, as desired. This will depend, of course, upon the particular thickness of any particular batch of compact discs to be silk-screen printed.

Importantly, however, and this is a key feature of the invention, the top member 18 is detachably connected to the base member 10. Thus, it is unnecessary, when compact discs are encountered of a different thickness or compact discs of a different diameter are to be silk-screen printed, to replace the entire disc fixture. The disc fixtures then on the rotatable transport member can readily be modified or retrofitted to accommodate the particular compact discs to be printed. The fact that the top member is detachable from the base member 10 allows not only for greater ease in providing a fixture having a compact disc nest of the desired diameter or thickness, it means that such can be provided in a much greater economical manner. Thus, the base member 10 of the fixture of the invention remains on the transport member and only the lesser expensive top member need be replaced. This allows for maintaining an inventory of much less costly components for retrofitting the disc fixtures provided on the transport member, as desired.

The top member 18 can be made detachably connected to the top surface 20 of the base member 10 in various ways; however, it is preferred that such detachable connection be provided by magnetic means. This can provide a secure connection between the top and base members while the compact discs are being transported from one station to another, yet allows the top member to be readily separated from the base member as and when desired, and, importantly, without need for use of any tools. Quite advantageously, as will be readily appreciated by those skilled in the art, the present invention reduces the time, hence the labor and costs, considerably, in providing a compact disc fixture on the transport member with a disc well of the required diameter and thickness.

The preferred means of providing detachable connection between the top member 18 and base member 10 is accomplished by providing a plurality of magnets in the base member, these being referred to in FIG. 1, in general, by reference numeral 48. Thus, there is shown in FIG. 1, a plurality of circular-shaped magnets 48 arranged in a circular-shaped pattern having a diameter greater than that of the compact disc nest 46. Those in the art will appreciate that the number of magnets to be provided in base 10 will depend somewhat upon the magnetic attraction desired for maintaining the top member in secure contact with the base member and the magnetic attraction provided by each magnet. In some cases, the number of magnets needed may only be four in number, these being provided in the conventional 12, 3, 6, and 9 o'clock locations. Any commercially available magnets can be used for the intended purposes, provided they accomplish the job of holding the top and base members together, as intended.

As shown in FIG. 2, the magnets 48 are located in dead bores 50 provided in the base member 10. These dead bores are preferably provided inwardly from the bottom surface 22 of the base member 10. The bottom of the each of the dead bores should terminate about 0.030 inches from the top surface 20; however, this will depend to some extent upon the number of magnets provided and the strength of the magnets. The magnets can be held in place by any suitable means e.g., epoxy resin, such as indicated in FIG. 2 of the drawing by reference numeral 51.

In a somewhat less desirable embodiment of the invention, the magnets can be located in dead bores provided inwardly from the top planar surface 20 of the base member. In this case, the top surface of each of the magnets will need necessarily lie in the same horizontal plane as that of the top surface 20 of the base member, or at least not above the plane of that surface.

The top member 18, or at least the bottom surface thereof, in opposition to the magnets 48 will need be in this embodiment of the invention of magnetic material. Thus, top member 18 can be of stainless steel, if desired, or of any other metallic material suitably attracted by the magnets. The top member need not be constructed entirely of magnetic material. Instead, if desired, the top member can be provided with only a bottom layer of magnetic material, e.g., a lamina or coating applied to the bottom layer of the top member. It will also be appreciated that the top member can be, if desired, a magnet with the base member being magnetic material; however, this is less desired.

Although in the more preferred aspects of the invention the detachable connection between the top member and base member is provided by magnetic means, other means, though perhaps somewhat less desirable, may also be used to accomplish this feature. For example, the top member 18 can be connected to the base member by threaded fasteners. Or, the top member can be connected to the base member by pressure-sensitive adhesive. Thus, a layer of such adhesive can be applied beforehand to the bottom surface of the top member, the outer surface to be attached to the base member being protected by a conventional release layer until the top member is to be attached to the base member. At that time the release layer will be removed and the top member laminated to the base member. Or a conventional double-faced pressure-sensitive adhesive tape can be used, if desired. Such a tape can be provided beforehand with an appropriate cut-out for the compact disc nest.

The manner in which the detachable connection can be provided in this embodiment of the invention will depend somewhat upon the particular materials used for the base and top members. The top member can be, if desired, of plastic material, or even of card board. Various plastic materials known to the art will be found suitable for this purpose, e.g. polyvinyl chloride resins, polyacetal resins, etc. In this case a plastic composition can be tailored to provide a top member with any physical characteristics desired, e.g., flexibility, hardness, frictional properties, etc. The base member, in this case, can be of metal, e.g., stainless steel, or it can also be provided of suitable plastic material. Thus, the top member, at least, can be an entirely disposable product, used perhaps in only one printing operation and then discarded.

As seen in FIG. 3, the top member 28 is provided with circular-shaped openings 52, 54, these being in opposition to one another. The openings 52, 54, as will be appreciated from the drawing, lie on an extension of the diameter of the circular-shaped opening 46 provided in the top member 18 and on a circle concentric to opening 46. The distance between the openings 52, 54 is of critical importance, as is their orientation or location. These two openings must match up with the pins 38, 40 provided on the base member 10, when the top member is connected to the base member. It will, of course, be appreciated by those skilled in the art that the top of the pins 38, 40 must be no higher than the plane of the top surface 42 of the top member 18. Desirably the tops of these pin will terminate below the plane of the top surface of the top member so as to ensure that such tops are not engaged by the squeegee in its travel.

Importantly, when the top and bottom members are connected together, the mating of the pins 38, 40 in the openings 52, 54 will provide that the circular-shaped well 46, the disc centerhole 56, and the circular-shaped openings 24 and 28 will all be concentric to one another, i.e., the centerpoint of each of these circles will lie on the same vertically upright line, as will be readily appreciated by reference to FIG. 2 of the drawing.

As will also be appreciated from FIG. 2, the diameters of circular-shaped openings 24 and 28 are each the same and of a like diameter as the centerhole 56 of the compact disc 26. This is important so that when the elongated circular-shaped registration pin (not shown) is raised vertically upwardly from its retracted location below the transport member 16, the registration pin will pass through and be guided by the circular-shaped openings 24 and 28 so as to intrude into the centerhole of the compact disc as such is being loaded into the well or nest provided by the top member 18. Thus, the compact disc 26 will be precisely registered for the subsequent silk-screen printing of the top surface of the disc. That registration will be maintained, and the disc held firmly against the top surface of the base member 10 by the vacuum provided in groove 30. The top surface of the base member, or at least that portion forming the bottom of the disc well 46 can be, if desired, provided with a low friction surface. This will better ensure that the bottom surface of the compact disc, the surface provided with the recorded information is not damaged by the sliding of the disc, though slighltly in the disc well while being registered.

As will be understood by those skilled in the art, various modifications and changes can be made in the invention and its form and construction without departing from the spirit and scope thereof. For example, the registration pins 38, 40 can be, instead, provided on the top member and the registration openings 52, 54 provided in the base member. Or even other registration means may be provided. The magnets need not necesarily be of a cylindrical shape. The magnets can be of any cross-sectional shape desired. Instead of providing a plurality of spaced-apart magnets, one magnet of annular shaped can be used in the practice of the invention, if desired. Other modifications will also occur to those skilled in the art after having read this disclosure of the invention.

The embodiments of the invention disclosed herein are merely exemplary of the various modifications that the invention can take and the preferred practice thereof. It is not desired to confine the invention to the exact construction and features shown and described herein, but it is desired to include all such as properly come within the spirit and scope of the invention disclosed and claimed.

What is claimed is:

1. Fixture for the holding of a compact disc in a horizontally disposed manner on a transport member while the compact disc is being transported to at least one work station comprising:

(a) a base member defined by top and bottom horizontally disposed, planar, surfaces parallel to one another and by a first circular-shaped, vertically disposed opening of predetermined diameter;

(b) a top member being detachably connected to the top planar surface of the base member, said top member being defined by top and bottom horizontally disposed, planar surfaces parallel to one another and to the top planar surface of the base member means for providing a well for a compact disc, said means including, a circular-shaped opening of predetermined diameter being provided in the top member concentric to the circular-shaped opening in the base member; and (c) means for detachably connecting the top member to the base member.

2. Fixture according to claim 1 wherein an annular-shaped groove of predetermined inner and outer diameters is provided in the base member, said groove extending inwardly from the top surface of the base member, the inner diameter of the annular-shaped groove being of a greater diameter than that of the first circular-shaped, vertically disposed opening in the base member and the outer diameter of the annular-shaped groove being of a lesser diameter than that of the circular-shaped opening in the top member, a second vertically disposed circular-shaped elongated opening being provided in the base member located outside the diameter of the first elongated circular-shaped opening and concentric to said first opening, an opening being provided in said groove for communication with the second vertically disposed opening, said second vertically disposed opening terminating at the bottom planar surface of the bottom member whereby means is provided for communication with a source of vacuum.

3. Fixture according to claim 1 wherein the top member comprises a plastic material and the means detachably connecting the top member to the base member comprises an adhesive.

4. Fixture according to claim 1 wherein a circular-shaped groove of predetermined diameter is provided in the base member, said groove extending inwardly from the top surface of the base member, the diameter of the groove being of a greater diameter than that of the first circular-shaped, vertically disposed opening in the base member and of a lesser diameter than that of the circular-shaped opening in the top member, a second vertically disposed elongated opening being provided in the base member located outside the diameter of the first elongated circular-shaped opening, an opening being provided in said groove for communication with the second vertically disposed opening in the base member, said second vertically disposed opening terminating at the bottom planar surface of the base member whereby means is provided for communication with a source of vacuum.

5. Fixture according to claim 1 wherein the means for detachably connecting the top member to the base member comprises magnetic means.

6. Fixture according to claim 5 wherein the magnetic means comprises at least one magnet being provided in the base member for attracting and holding the bottom surface of the top member against and in contact with the top surface of the base member and the top member is of magnetic material.

7. Fixture according to claim 6 wherein a plurality of dead bores are provided in the top surface of the base member and extend inwardly into the base member, and a magnet defined by a top planar surface is located in each of the dead bore, said top planar surface being in the same plane as the top planar surface of the base member.

8. Fixture according to claim 1 wherein means are provided on the base member for operative association with complementary means being provided on the top member for providing registration of the top member with the base member so that the circular-shaped openings provided in each of said members are in concentric relationship to one another.

9. Fixture according to claim 8 wherein said means provided on the base member comprises at least two elongated pins of predetermined length extending vertically upwardly from the top surface of the base member, said elongated pins being in opposition to one another and being located on a diameter of the circular-shaped opening of the base member, the complementary means being provided on the top member being at least two openings being provided in opposition to one another and on a diameter of the circular-shaped opening of the top member, said at least two openings being of a like number as the pins in the base member and being spaced apart from one another a sufficient distance so as to provide for operative engagement with the pins provided on the base member.

10. System for the silk-screen printing of compact discs comprising:

(a) a rotatable transport member defined by a top horizontally disposed planar surface for the transporting of a plurality of compact discs one-at-a-time to one or more printing stations and by a plurality of spaced-apart vertically extending circular shaped openings;

(b) a plurality of compact disc fixtures being provided on the top surface of the transport member, each said disc fixture being spaced apart from another by a predetermined distance and being defined by a base member and a top member, the base and top members each being defined by planar parallel top and bottom surfaces parallel to the top planar surface of the transport member, a circular-shaped opening being provided in each said base member concentric with and of the same diameter as the circular-shaped opening in the rotatable transport member, and a circular-shaped opening of predetermined diameter being provided in the top member, said circular-shaped opening in the top member being of a predetermined diameter greater than that provided in the base member and being concentric therewith, whereby when the bottom surface of the top member is operatively engaged with the top surface of the bottom member a well is provided for the holding of a compact disc.

11. Fixture for the holding of a compact disc in a horizontally disposed manner on a transport member for the compact disc comprising:

(a) a base member defined by top and bottom horizontally disposed, planar, surfaces parallel to one another, a first circular-shaped, vertically disposed, elongated opening of pretermined diameter being provided in the base member and extending from the top surface to the bottom surface of said body member, a second elongated opening being provided in the base member located outside the predetermined diameter of said first circular-shaped, vertically disposed, elongated opening in the body member, a circular-shaped groove being provided in the base member having a diameter greater than that of the first circular-shaped, vertically disposed, elongated opening, said groove extending inwardly from the top surface of the body member and being in communication with the second vertically disposed, elongated opening provided in the body member;

(b) a top member detachably connected to the top surface of the base member, said top member being defined by top and bottom horizontally disposed, planar surfaces parallel to one another and to the top surface of the base member, a circular-shaped opening of predetermined diameter being provided in the top member and extending from the top surface of the top member to the bottom surface of the top member, said cirular-shaped opening in the top member being of a diameter greater than that of the first circular-shaped opening in the base member and concentric to said first circular-shaped opening in the base member, the second circular-shaped opening provided in the base member being located within the circle subscribed by the circular-shaped opening in the top member; and (c) means for detachably connecting the top member to the base member.

12. Fixture according to claim 11 wherein the top member comprises a plastic material and the means detachably connecting the top member to the base member comprises an adhesive.

13. Fixture according to claim 11 wherein means are provided on the base member and complementary means are provided on the top member in operative association for providing registration of the top member with the base member whereby the circular-shaped opening provided in the top member and the first circular-shaped, vertically disposed, elongated opening provided in the body member are provided in concentric relationship to one another.

14. Fixture according to claim 13 wherein said means provided on the base member comprises at least two elongated pins of predetermined length extending vertically upwardly from the top surface of the base member, said elongated pins being in opposition to one another and being located on a diameter of the circular-shaped opening of the base member, the complementary means being provided on the top member being at least two openings being provided in opposition to one another and on a diameter of the circular-shaped opening of the top member, said at least two openings being of a like number as the pins in the base member and being spaced apart from one another a sufficient distance and in such locations as to provide for operative engagement with the pins provided on the base member.

15. Fixture according to claim 11 wherein the top member is of a predetermined thickness.

16. Fixture according to claim 11 wherein the means for detachably connecting the top member to the base member comprises magnetic means.

17. Fixture according to claim 16 wherein the magnetic means comprises at least one magnet being provided in the base member for attracting and holding the bottom surface of the top member against and in contact with the top surface of the base member and the top member is of magnetic material.

18. Fixture according to claim 17 wherein a plurality of magnets arranged in a circular-shaped pattern of predetermined diameter are provided in the base member and the circular-shaped pattern of magnets is concentric with the circular-shaped opening in the base member and of a diameter greater than that of the circular-shaped opening in the top member.

19. Fixture according to claim 17 wherein at least one dead bore is provided in the top planar surface of the bottom member and said at least one magnet is located in said at least one dead bore, said at least one magnet being defined by a top planar surface being located in a plane no higher than that of the top planar surface of the bottom member.

20. Fixture according to claim 18 wherein a plurality of elongated dead bores each being defined by a flat bottom are provided in the base member of the fixture, said dead bores each extending inwardly from the bottom surface of the base member a predetermined distance and terminating at said flat bottom below the top surface of the base member, the dead bore flat bottoms and top surface of the base member being in parallel planes with respect to one another, and a magnet defined by a top planar surface is located in each of the dead bores, the top planar surface of each of the magnets being in contact with the bottom of a dead bore.

21. Fixture according to claim 20 wherein means is provided to hold each magnet in a dead bore so as to maintain the top planar surface of the magnet in contact with the flat bottom of the dead bore.

22. Fixture according to claim 21 wherein the holding means comprises an adhesive material.

23. Fixture according to claim 20 wherein each of the dead bores terminates at a distance of about 0.030 inches below the the top surface of the base member.

* * * * *